US009253571B2

(12) United States Patent
Aubreville et al.

(10) Patent No.: US 9,253,571 B2
(45) Date of Patent: Feb. 2, 2016

(54) HEARING APPARATUS FOR BINAURAL SUPPLY AND METHOD FOR PROVIDING A BINAURAL SUPPLY

(71) Applicant: SIVANTOS PTE. LTD., Singapore (SG)

(72) Inventors: Marc Aubreville, Nuremberg (DE); Eghart Fischer, Schwabach (DE); Homayoun Kamkar Parsi, Erlangen (DE); Stefan Petrausch, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 337 days.

(21) Appl. No.: 13/851,504

(22) Filed: Mar. 27, 2013

(65) Prior Publication Data

US 2013/0259239 A1 Oct. 3, 2013

(30) Foreign Application Priority Data

Mar. 27, 2012 (DE) ..... 10 2012 204 877

(51) Int. Cl.
*H04R 25/00* (2006.01)
*H04R 5/00* (2006.01)

(52) U.S. Cl.
CPC ..... *H04R 5/00* (2013.01); *H04R 25/405* (2013.01); *H04R 25/407* (2013.01); *H04R 25/552* (2013.01); *H04R 2410/01* (2013.01); *H04R 2430/21* (2013.01)

(58) Field of Classification Search
CPC ..... H04R 25/60; H04R 25/65; H04R 25/70; H04R 25/356; H04R 25/402; H04R 25/405; H04R 25/406; H04R 25/407; H04R 25/505; H04R 25/552; H04R 25/554; H04R 25/604; H04R 25/652; H04R 2225/021; H04R 2225/025; H04R 2225/41; H04R 2225/63; H04R 2410/01; H04R 2430/21; H04R 3/005
USPC ..... 381/312, 313, 327, 328, 330
See application file for complete search history.

(56) References Cited

U.S. PATENT DOCUMENTS 3,257,516 A 6/1966 Knowles
6,549,634 B1 4/2003 Vonlanthen (Continued)

FOREIGN PATENT DOCUMENTS

DE 10 2008 015 263 A1 10/2009
EP 1 183 907 A1 3/2002

(Continued)

OTHER PUBLICATIONS

Baeuml, R., et al. "Uniform Polyphase Filter Banks for Use in Hearing Aids: Design and Constraints", 16th European Signal Processing Conference (EUSIPCO 2008), Aug. 25-29, 2008, Lausanne, Switzerland.

(Continued)

*Primary Examiner* — Brian Ensey
(74) *Attorney, Agent, or Firm* — Laurence A. Greenberg; Werner H. Stemer; Ralph E. Locher

(57) ABSTRACT

A hearing apparatus for a binaural supply contains a first earhook to be worn on one ear, having a plurality of microphones, and a first signal processing device which is configured to generate a local earpiece signal for an earpiece of the first earhook from microphone signals of the microphones by use of multichannel signal processing of each of the microphone signals. A beam forming device and a transmission device are additionally provided in the first earhook. The beam forming device is configured to generate a directional output signal from the microphone signals by signal processing which has fewer channels than that of the first signal processing device, and wherein the transmission device is set up to transmit the directional output signal as an electrical or electromagnetic signal from the first earhook.

11 Claims, 3 Drawing Sheets

(56) References Cited

U.S. PATENT DOCUMENTS

| | | | | |
|---|---|---|---|---|
| 7,359,520 | B2 | 4/2008 | Brennan et al. | |
| 8,126,153 | B2 | 2/2012 | Fischer | |
| 2010/0002886 | A1 | 1/2010 | Doclo et al. | |
| 2010/0135500 | A1 * | 6/2010 | Derleth et al. | 381/23.1 |
| 2012/0070015 | A1 | 3/2012 | Oh et al. | |

FOREIGN PATENT DOCUMENTS

| | | | |
|---|---|---|---|
| EP | 1 183 907 | B1 | 2/2011 |
| EP | 2431973 | A1 | 3/2012 |
| WO | 03015464 | A2 | 2/2003 |
| WO | 2007128825 | A1 | 11/2007 |

OTHER PUBLICATIONS

Gomez P et al: "Time-domain steering of a differential beamformer for speech enhancement and source separation", Signal Processing, 2002 6th International Conference on Aug. 26-30, 2002, Piscataway, NJ, USA,IEEE, vol. 1, Aug. 26, 2002, pp. 338-341, XP010627993, ISBN: 978-0-7803-7488-1.

Bogaert,Doclo,Moonen,Wouters: "Speech enhancement with multichannel Wiener filter techniques in multimicrophone binaural hearing aids", Journal of the Acoustical Society of America, vol. 125, No. 1, Jan. 31, 2009, pp. 360-371, XP002702378, USA.

* cited by examiner

HEARING APPARATUS FOR BINAURAL SUPPLY AND METHOD FOR PROVIDING A BINAURAL SUPPLY

CROSS-REFERENCE TO RELATED APPLICATION

This application claims the priority, under 35 U.S.C. §119, of German application DE 10 2012 204 877.4, filed Mar. 27, 2012; the prior application is herewith incorporated by reference in its entirety.

BACKGROUND OF THE INVENTION

Field of the Invention

The invention relates to a hearing apparatus having an earhook to be worn on one ear, the earhook having a plurality of microphones and a signal processing device. This is configured to generate an earpiece signal for an earpiece of the earhook from microphone signals of the microphones by multichannel signal processing of each of the microphone signals. Also forming part of the invention is a method for providing a binaural supply by use of two earhooks of a hearing apparatus, each of which is worn on an ear. "Binaural supply to the user" here means that the earpiece signal of an earhook is additionally formed as a function of at least one microphone signal of a microphone which is located in another earhook.

The term "hearing apparatus" is understood here generally to mean any sound-emitting device that can be worn in or on the ear, in particular a hearing device, a headset, a set of earphones and the like. Hearing devices here represent wearable hearing apparatuses, which serve to assist people with hearing difficulties. In order to accommodate numerous individual requirements, various types of hearing devices are available such as behind-the-ear (BTE) hearing devices, hearing devices with an external earpiece (RIC: receiver in the canal) and in-the-ear (ITE) hearing devices, for example also concha hearing devices or completely-in-the-canal (ITE, CIC) hearing devices. The hearing devices listed by way of example are worn on the outer ear or in the auditory canal. Also available on the market are bone conduction hearing aids, implantable hearing aids and vibrotactile hearing aids. With these the damaged hearing is stimulated either mechanically or electrically.

A hearing system for binaural supply to a user is known from published, non-prosecuted German patent application DE 10 2008 015 263 A1, corresponding to U.S. Pat. No. 8,126,153, and has two earhooks, each with a plurality of microphones and a signal processing device. Each earhook further contains a beam forming device and a transmission device for transmitting a signal to the other hearing apparatus in each case.

Hearing devices in principle have the following key components: an input transducer, an amplifier and an output transducer. The input transducer is generally a sound receiver, e.g. a microphone, and/or an electromagnetic receiver, e.g. an induction coil. The output transducer is usually implemented as an electroacoustic converter, e.g. a miniature loudspeaker, or as an electromechanical converter, e.g. a bone conduction earpiece. The amplifier is generally integrated into a signal processing unit. This basic structure is illustrated in FIG. 1 using the example of a behind the ear hearing device. Incorporated in a hearing device housing 1 to be worn behind the ear are one or more microphones 2 for picking up ambient sound. A signal processing unit 3, which is also integrated into the hearing device housing 1, processes and amplifies the microphone signals. The output signal of the signal processing unit 3 is transmitted to a loudspeaker or earpiece 4, which outputs an acoustic signal. The sound is optionally transmitted by way of a sound tube, which is fixed with an otoplastic in the auditory canal, to the eardrum of the device wearer. Power for the hearing device and in particular for the signal processing unit 3 is supplied by a battery 5 which is also integrated into the hearing device housing 1.

For processing the local microphone signals of the microphones 2 the signal processing unit 3 generally has a multichannel processing facility. In this case each microphone signal is split onto a plurality of channels which have different average frequencies. The signals are split for example by a filter bank or a discrete Fourier transformation (DFT). Thus a spectral portion of the respective microphone signal can be processed in each channel regardless of the other spectral portions thereof.

As shown in FIG. 1, a single behind the ear hearing device, or generally an earhook, can also have a plurality of microphones 2. Their microphone signals can be combined by what is known as beam forming into a directional output signal, i.e. the signal components of different noise sources in the environment of the user are attenuated more or less strongly in the case of the directional output signal, as a function of the direction from which the respective noise has hit the microphone arrangement. In other words a direction-dependent noise detection sensitivity is produced if beam forming is connected downstream of the microphone arrangement. The assignment function, which describes the dependency of the noise detection sensitivity on the angle of incidence of the noise, is designated as a directional characteristic. In order to enable a terminological distinction from binaural processing to be made below, beam forming which only processes microphone signals from microphones in a single earhook is designated as monaural beam forming and its output signal as a directional monaural signal.

In contrast, in the case of binaural beam forming microphone signals are combined with one another, at least one of which was detected at one ear and one at the other ear of the user. Instead of the microphone signals themselves, signals derived from these microphone signals can also be processed in the case of binaural beam forming. As the microphones in different earhooks are spaced much further apart (approximately 17 cm) than the microphones in an individual earhook (approximately 1 to 2 cm), other directional characteristics can be correspondingly formed by the binaural beam forming. The directional detection of low-frequency signal portions is in particular facilitated thereby. The directional characteristics can in this case be particularly well formed on a frequency-selective basis if the beam forming is performed in individual channels of a multichannel filter bank. The number of channels used here is usually more than 16. In order now to be able to combine microphone signals from both earhooks in binaural beam forming, it is necessary to transmit the signals to a common signal processing device. To this end it is known to transmit an audio signal in the form of a time signal via a cable, or via a radio connection such as Bluetooth, between two earhooks from one earhook to another.

The signal received can then be combined with the local microphone signals in the other earhook by the latter's multichannel signal processing device. One problem with the transmission techniques currently available is that their bandwidth is limited such that microphone signals from a plurality of microphones cannot be transmitted fast enough, but merely a single time signal. For example, only a single microphone signal can be exchanged between the earhooks per transmission direction. For the directional characteristic of the binaural beam forming, this then means that it has an axial symmetry, wherein the symmetrical axis runs perpendicular to the straight-ahead direction, i.e. through both the user's ears. If therefore it is desired to receive the noise signal from a source located in front of the user with maximum sensitivity, the consequence is that the noise signal from a source located behind the user is received with the same sensitivity. In order to circumvent this undesired effect a directional monaural signal can be generated in each earhook initially by monaural beam forming, wherein the signal from the noise source located behind the user is attenuated in comparison to that from the noise source located in front of the user. These directional monaural signals can then be transmitted for binaural beam forming. The aforementioned multichannel signal processing can likewise be used for monaural beam forming. However, such upstream signal processing results in a time delay for the signal, which is generally in the range of approximately 6 ms. If such a directional monaural signal is now transmitted via the aforementioned transmission device and the desired binaural audio signal is then calculated in the second signal processing device, the result can be an overall signal delay which lies in the range of approximately 18 ms (2×6 ms+6 ms transmission time).

Such an overall delay is not acceptable for hearing apparatuses which present an ambient noise to a user via microphones. For example, when typing at a computer the user always hears the clicking of the keyboard keys 18 ms after he has pressed a key. This time delay is generally found to be bothersome, as no tactile/acoustic link is experienced. In such a case the time delay aimed for is in the region of 10 ms, but this can only actually be achieved with very simple systems for audio signal processing.

SUMMARY OF THE INVENTION

It is accordingly an object of the invention to provide a hearing apparatus for binaural supply and a method for providing a binaural supply which overcome the above-mentioned disadvantages of the prior art methods and devices of this general type, which provides binaural beam forming that has a short time delay.

With the foregoing and other objects in view there is provided, in accordance with the invention a hearing apparatus for a binaural supply. The hearing apparatus has a first earhook to be worn on an ear. The first earhook contains an earpiece, a plurality of microphones, and a first signal processing device having channels. The first earhook generates a local earpiece signal for the earpiece from microphone signals of the microphones using multichannel signal processing of each of the microphone signals. A beam forming device having channels is provided and generates a directional output signal from the microphone signals using signal processing which has fewer channels than that of the first signal processing device. A transmission device is set up to transmit the directional output signal as an electrical or electromagnetic signal from the first earhook.

In the case of the inventive hearing apparatus, not only is the actual multichannel signal processing device known per se provided in an earhook to be worn on the ear for processing microphone signals from a plurality of microphones, but additionally a processing device designated here as a beam forming device and a transmission device. The beam forming device differs from the multichannel signal processing device in that it can generate a directional output signal from the microphone signals and to this end has a signal processing facility having fewer channels than the multichannel signal processing device. Thus a directional monaural signal is generated in the earhook on the basis of just one channel or at least a few channels. The transmission device is designed to transmit this directional output signal as an electrical or electromagnetic signal from the first earhook. For example, the output signal can thus be transmitted to another earhook on the user's other ear, where it can then be used for a binaural supply.

In the same way, the other earhook can of course correspondingly have a plurality of microphones as well as a beam forming device and a transmission device like the first earhook. Expediently the two earhooks are then designed to transmit their respective directional output signals via their transmission devices to the respective other earhook and then to generate a directional earpiece signal respectively on the basis of microphone signals from their own microphones and of the signal received from the other earhook by the binaural beam forming described, it being possible to output the directional earpiece signal on the local, i.e. own earpiece. "Output of the earpiece signal by an earpiece" here means either the generation of a noise or else, as for example in the case of a cochlea implant, the generation of electrical pulses. The procedures described here for generating the directional earpiece signal correspond to the steps as specified by the inventive method.

The invention has the advantage that the directional output signal to be transmitted via the transmission device can be generated with significantly less signal delay than is possible by the multichannel signal processing device. A significant part of the delay is in fact caused by the signal analysis by for example of an analysis filter bank and the signal synthesis required following processing by a synthesis filter bank. The signal delay here depends on the spectral resolution of the filter banks, because correspondingly longer analysis or synthesis filters are necessary for narrower-band processing (channels with a low bandwidth). The beam forming device of an earhook enables the multichannel signal processing device to be circumvented and nevertheless a directional output signal to be provided for the respective other earhook.

In connection with the invention, "multichannel signal processing" here means that the multichannel signal processing unit has more than 16 channels, in particular 48 channels. In order to obtain the inventive advantage described, the beam forming unit in contrast preferably has 16 or fewer than 16, in particular 4, channels. Single-channel processing is also possible here.

For a particularly low signal delay each of the microphone signals is expediently split by the beam forming device by filtering them to the channels of the beam forming device. In the case of dual-channel processing the filtering is expediently performed by a low-pass filter and a high-pass filter. In the case of more channels one or more band-pass filters are correspondingly provided. Particularly efficient and low-delay filtering is effected in the case of the low number of channels used here by time domain filtering.

Unlike in a filter bank, in the case of the beam forming device each microphone signal is preferably processed in the time domain without sub-sampling. In other words a sampling rate which the microphone signals have at the input to the beam forming device (for example 12 kHz or 16 kHz) is also retained after a respective splitting of the microphone signals onto the channels of the beam forming device. Thanks to the microphones and the downstream beam forming device a time-signal-based directional microphone device is thus formed overall. This has the advantage that to synthesize the directional output signal the signals of the individual channels simply have to be overlaid additively. In particular no up-sampling is required.

As regards the type of beam forming as is performed in each of the channels of the beam forming device on the basis of the corresponding signal portions of each microphone signal, it has proved particularly expedient to use a differential beam former in each of the channels. For implementation, reference is made here to the prior art, as differential beam formers are known in many different forms.

The beam former of the beam forming device provided in a channel can in this case be designed adaptively, such as a Griffiths and Jim beam former, for example. The advantage of an adaptive beam former is that the beam forming device can be operated independently of the multichannel signal processing device.

To reduce the computing effort in an earhook provision can however be made for a beam former to be provided in one channel in the case of the beam forming device, in which beam former a directional characteristic can be set via an actuating parameter from outside the beam forming device. This form is here called a controlled beam former. Provision is here made for the actuating parameter to be set by the signal processing device. The advantage of this embodiment is that no calculations for adapting the directional characteristic to the current auditory situation are required in the controlled beam former itself. Instead, information and calculation results from the multichannel processing in the signal processing device can also be used in the beam forming device.

Thus a development of the hearing apparatus provides that an adaptive beam former is provided in at least one channel in the multichannel signal processing device itself. This can then be used for processing the local microphone signals in connection with the actual binaural beam forming. If at least one such adaptive beam former is present in the multichannel signal processing device, provision can thus be made for the actuating parameter of at least one controllable beam former of the beam forming device to be set to a value which is calculated from an actuating parameter of the at least one adaptive beam former. For example, provision can be made, in the case of a 48-channel signal processing device on the one hand and for example a 4-channel beam forming device on the other hand, to calculate an average value from the values of the actuating parameters for the directional characteristic of 12 adaptive beam formers of the signal processing device in each case, the average value then being used as the value for the actuating parameter of a controllable beam former of the beam forming device.

Examples of transferable actuating parameters here include an adjustment factor required in a channel, with which the level of a microphone signal is adjusted to the level of the other microphone signal such that noises of the same volume are also represented as digital signals with the same amplitude. Differences can result here because of manufacturing tolerances of the microphones themselves, differences in the processing of the signals, such as may result for example because of temperature differences in the components, or because of the position of the microphones on the head. A second important actuating parameter is the specification of the direction of the least sensitivity. This minimum sensitivity (notch) indicates the direction from which a signal must hit the earhook for it to be subject to the maximum attenuation in the directional signal. This direction is particularly important for masking out noises from a source of interference.

As already mentioned, provision can be made in the case of the inventive hearing apparatus for two earhooks to exchange monaural directional signals. To this end a receiving device is additionally provided in each earhook for electrical or electromagnetic signal reception of an input signal. The directional signal from a beam forming device can be received from its transmission device via this receiving device. The receiving device and the transmission device can be components for connecting two earhooks known from the prior art. The signal can of course also be received from another source.

The invention also comprises developments of the inventive method which have features as have been described here in connection with the inventive hearing apparatus. For this reason the corresponding developments of the inventive method are not described again here.

Other features which are considered as characteristic for the invention are set forth in the appended claims.

Although the invention is illustrated and described herein as embodied in a hearing apparatus for binaural supply and a method for providing a binaural supply, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the example explained below the components described of the hearing apparatus each represent individual features of the hearing apparatus to be considered separately from one another, which each also develop the hearing apparatus independently of one another and thus are also to be regarded individually or in a combination other than that shown as a component part of the invention.

Figure 1:
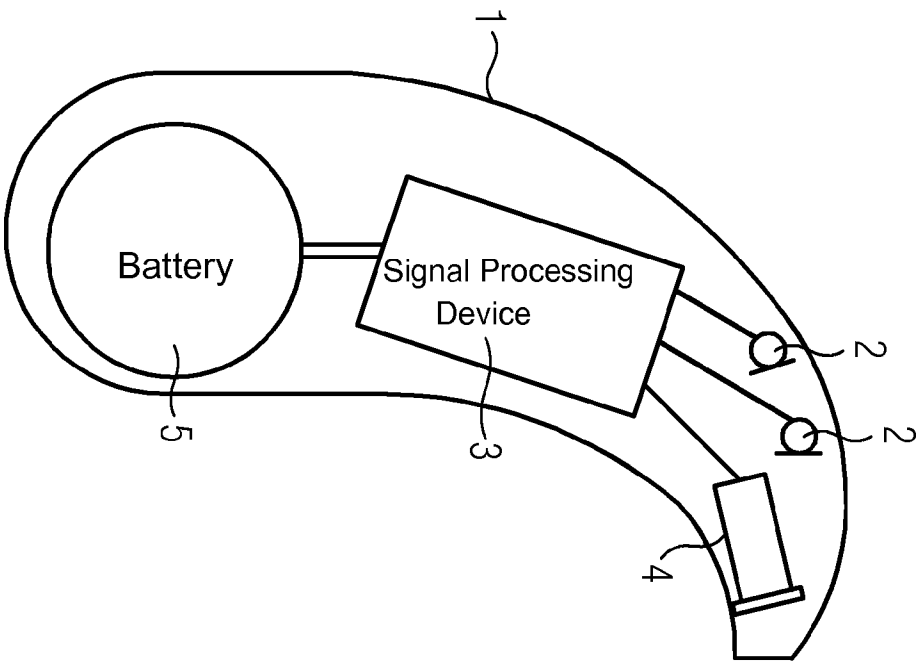
FIG 1 PRIOR ART
FIG. 1 is a schematic representation of a manner of construction for a behind the-ear hearing device in accordance with the prior art.
Figure 2:
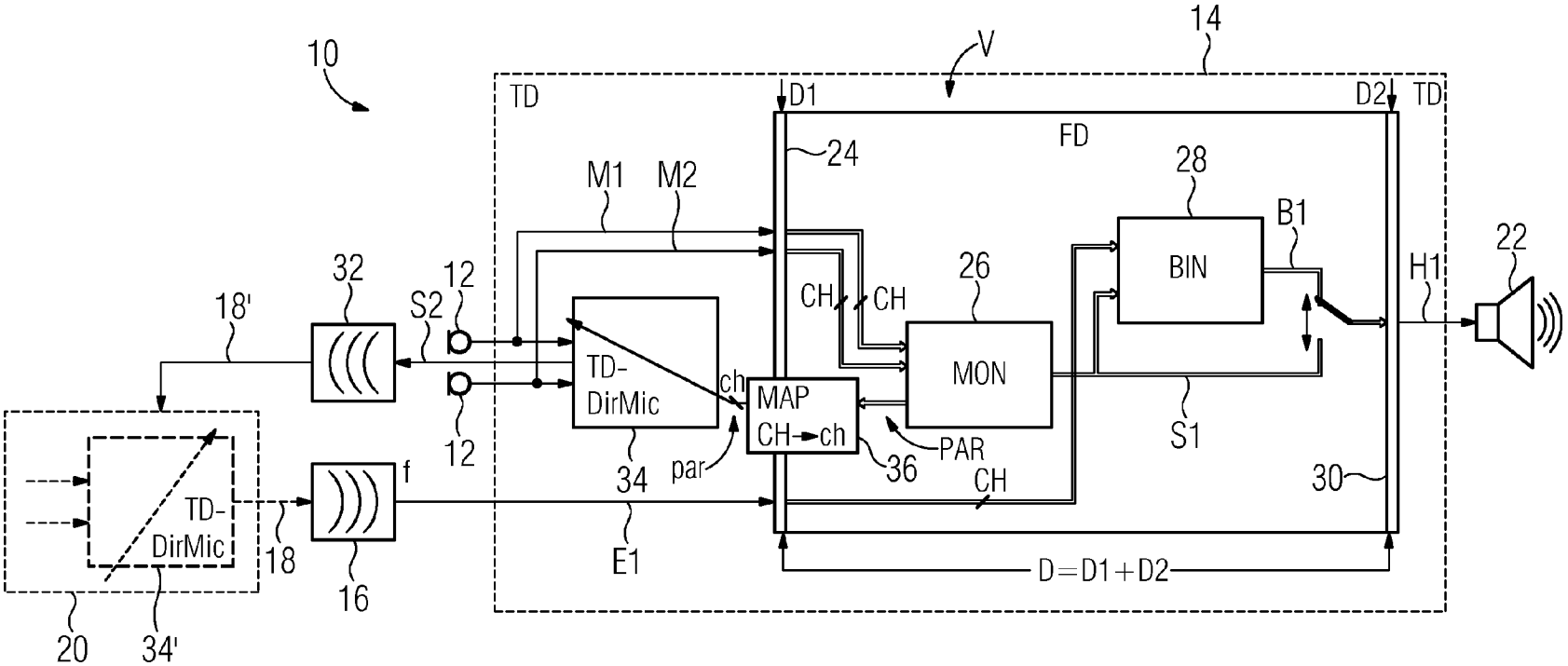
FIG. 2 is a schematicized block diagram of a preferred embodiment of the hearing apparatus according to the invention.

Referring now to the figures of the drawing in detail and first, particularly, to FIG. 2 thereof, there is shown an earhook 10 of a hearing apparatus that a user of the hearing apparatus wears on one ear. The earhook 10 can for example be a behind the ear hearing device or an in the ear hearing device. The earhook 10 has two microphones 12, the signals of which are processed by a digital signal processor 14 (DSP). The signal processor 14 further receives a single-channel time signal via an electronic receiving device 16. The time signal is transmitted to the receiver 16 via a data link 18, for example a cable, a radio link or an infrared link, from another earhook 20 which the user is wearing on his other ear. The signal processor 14 generates an earpiece signal H1 from the microphone signals M1, M2 of the local microphones 12 and the reception signal E1 received by the receiver 16, the earpiece signal H1 being emitted as a noise signal by an earpiece 22 of the earhook 10 into an auditory canal of the ear on which the user is wearing the earhook 10. The earpiece 22 may also be an electrical output unit of a cochlea implant.

For the generation of the earpiece signal H1 the microphone signals M1, M2 and the reception signal E1, which each represent time signals, are transformed from the time domain TD into a frequency domain FD by a frequency analysis device 24 of a multichannel signal processing device V. The frequency analysis device 24 may for example be a filter bank or a Fourier transformation. For the present example it can be assumed that as a result of the frequency analysis device 24 each of the signals M1, M2, E1 is split overall onto a number CH of channels, the number CH of channels being for example CH=48. Thanks to the transformation by use of the frequency analysis device 24 the microphone signals M1, M2 and the reception signal E1 are delayed by a delay D1, where for example D1=3 ms. The transformed microphone signals M1, M2 are combined in each of the channels in the frequency domain FD by a beam former in each case (illustrated overall as a beam former 26) to form directional sub-band signals. Thanks to the overall CH beam formers 26 a monaural directional signal S1 is generated on the basis of the microphone signals M1, M2 of the microphones 12 in the frequency domain FD. This and the transformed input signal E1 are combined by binaural beam formers 28 in each channel of the frequency domain FD to form sub-band signals of a directional binaural signal B1. The beam formers 26, 28 may be conventional adaptive frequency domain beam formers, whereby in the case of the beam formers 28 use is made of the fact that a spatial distance between the microphones 12 on the one hand and the microphones (not shown) from whose signals the input signal E1 is formed, is greater than that between the microphones 12 themselves. The user of the hearing apparatus can use a switch 30 to choose whether he would like to route the directional binaural earpiece signal B1 or else the directional monaural signal S1 to a synthesis device 30. Thanks to the synthesis device 30 the individual sub-band signals (overall CH in number) are combined to form a time domain signal, the earpiece signal H1. The synthesis device 30 may for example be a synthesis filter bank or an inverse Fourier transformation. The result of the synthesis is a further signal delay D2, which for example may be D2=3.

Overall an overall signal delay D, as produced by processing the microphone signals M1, M2 and the input signal E1 to form the earpiece signal H1, is thus at least D=D1+D2, in other words in the case of the examples given D>6 ms realistically.

Thanks to the earhook 10 another directional monaural signal S2 is generated, which is transmitted from a transmission device 32 of the earhook 10 to the other earhook 20. The transmission can, as in the case of the link 18, likewise take place via a data link 18' in electrical or electromagnetic form. The directional monaural signal S2 is here generated by a time domain beam former device 34 (TD-Dir-Mic—Time Domain Directional Microphone) different from the signal processing facility V from the microphone signals M1, M2 of the local microphones 12. Unlike the directional monaural signal S1, which is generated by the spectral signal processing facility V1 in the frequency domain FD, the directional monaural signal S1 is exclusively generated by processing the microphone signals M1, M2 in the time domain TD, so that as a result of this processing no significant signal delay is caused as a result of a transformation. In other words the signal S2 can be output without the overall delay D from the earhook 10 via the transmission device 32.

The beam forming device 34 can nevertheless have more than one channel for processing. A number ch of the channels of the beam forming device 34 is however smaller than the number CH of the channels of the processing device V. For example, provision can be made in the case of the beam forming device 34 for each of the microphone signals M1, M2 to be split by a low-pass, two band-passes and a high-pass onto a total ch=4 channels with different medium frequencies. In each of the ch channels the beam forming device 34 has a beam former, in particular a differential beam former for time domain beam forming, as is known from the prior art. A beam former need not be provided in every channel. Thus for example a beam former can be dispensed with for the low-pass-filtered component of the microphone signals M1, M2, as beam forming for low frequencies by the microphones 12 arranged relatively close to one another (in the range of less than 4 cm, for example) may not be effective under certain circumstances.

The signals are processed in the beam forming device 34 as time domain signals, i.e. so-called "downsampling" does not occur. Therefore the sub-band signals of the individual channels of the beam forming device 34 can be combined by additive overlaying without any further signal delay to form the directional monaural signal S2.

The beam formers of the beam forming device 34 may be adaptive beam formers. However, controlled beam formers are preferably used, the directional characteristics of which can be set via control parameters which can be predetermined from outside the beam forming device 34. In the example shown in FIG. 2 a total of ch actuating parameters par can be transferred to the beam forming device 34 to set the directional characteristics of each beam former in the ch channels of the beam forming device 34. The parameters par are calculated by a conversion device 36 from directional parameters PAR of the beam formers 26 (MAP—mapping). If the beam formers 26 are adaptive beam formers, their directional parameters PAR are adjusted using corresponding optimization algorithms in a manner known per se to the spatial position of the sources of useful and interference noise.

The mapping device 36 may be provided for example for a particular channel of the beam forming device 34 to take into account those channels of the beam forming device 26 which together cover the same frequency domain as the channel of the beam forming device 34. For all these channels the actuating parameter of the beam formers 26 can then be read out by the mapping device 36 and the actuating parameter value for the beam former of the corresponding channel of the beam forming device 34 can be calculated therefrom, for example by calculating the average value. Exactly how the PAR manipulated variables should be mapped to the par manipulated variables depends, for example, on the specific design of the hearing apparatus and can be determined by simple experiments. Besides averaging, the calculation of a geometric average or else the selection of an individual particular actuating parameter value is also conceivable, for example. The latter may for example be expedient if an especially large amount of signal output is identified in a particular channel.

The directional binaural signal S2 sent by the transmission device 32 via the data link 18' represents an input signal in the other earhook 20, like the input signal E1 in the case of the earhook 10. In comparable fashion a beam forming device 34' is provided in the other earhook 20 for time domain beam forming, from which the reception signal E1 emanates. The beam forming device 34' of the earhook 20 can be operated in the same way as the beam forming device 34 in the earhook 10. Accordingly the output signal of this beam forming device 34' forms a directional monaural signal which is received via the data link 18 by the reception device 16 as the input signal E1.

The choice of the number ch of channels of the beam forming devices 34 and 34' represents an offset between the signal delay caused by the beam forming device 34 and the possibility of also setting different directional characteristics for signal components of different frequencies. In the present example using ch=4 channels, it is possible, by the beam forming device 34, 34', to reduce the signal delay caused by the beam forming device 34, 34' to 1 ms.

By supplying the reception signal E1 and accordingly also the directional monaural signal S2 with a slight delay of this type, it is possible to increase the overall delay resulting from operating the binaural beam formers 28 in the hearing apparatus only slightly compared to the overall delay D. If it is assumed that the transmission via the links 18, 18' lasts a further 6 milliseconds, this produces an overall delay of D'=D1+D2+6 ms+1 ms=13 ms in the present example.

Figure 3:
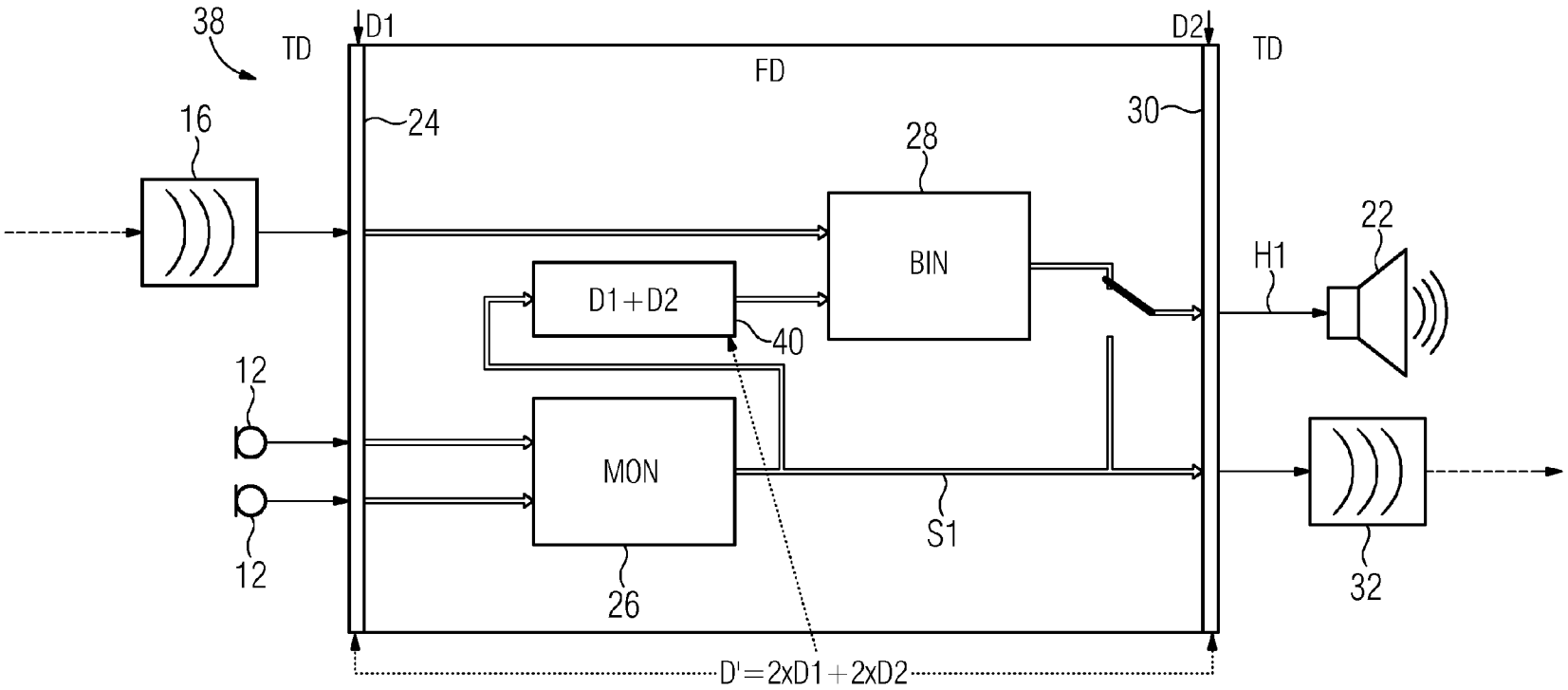
FIG 3 PRIOR ART
FIG. 3 is a schematicized block diagram of the hearing apparatus according to the prior art.

To once again make clear this advantage described by the inventive configuration of the hearing apparatus, an earhook 38 for a binaural supply is once again shown in FIG. 3, configured as was necessary for a hearing apparatus from the prior art. To simplify the comparison, elements corresponding in their function to elements of the hearing apparatus in FIG. 2 are provided with the same reference characters in FIG. 3 as in FIG. 2. In the case of the earhook 38 it is likewise possible to generate spectrally high-resolution beam forming and as a result a directional monaural signal S1 in the frequency domain FD from microphone signals from microphones 12 in the frequency domain FD using beam formers 26. If this directional monaural signal S1 is to be used not just for local binaural beam formers 28, but also as an input signal for another earhook, the signal S1 must be transformed back into the time domain TD using a synthesis device 30, so that it can then be transmitted from a transmission device 16 to the other earhook. Thus the signal sent from the transmission device 16 to the other earhook already has a delay D=D1+D2. Accordingly an input signal is also received via a reception device 16, which input signal has been generated by the other earhook likewise using its spectrally high-resolution processing and hence likewise already having a signal delay D=D1+D2. This monaurally directional input signal of the other earhook must be transformed with the microphone signals of the microphones 12 by an analysis device 24 in the frequency domain FD so that it can be processed by the binaural beam formers 28. As the signal received via the reception device 16 now already has a signal delay D=D1+D2, the signal S1 obtained from the microphone signals 12 must be delayed by a delay unit 40 by this exact delay D1+D2 in order to synchronize the two input signals of the binaural beam formers 28. However, because of the additional delay required by the delay unit 40 this results in an overall delay D'=2*D1+2*D2 when generating an earpiece signal H1 from the microphone signals of the microphones 12 and the signal from the other earhook received via the reception device 16. If a transmission time of 1 ms is then added to this, this results in an overall delay D'=12 ms. Added to this is the transmission time, which as before can be estimated as 6 ms. Thus a user of this hearing apparatus perceives the disruptive time offset mentioned in the introduction, for example when typing at a computer.

Thanks to the hearing apparatus illustrated in FIG. 2 it is in contrast possible to provide a directional signal S2 in the earhook 10 for the transmission to the other earhook without the signal delay caused by the transformation into the frequency domain FD. At the same time the additional calculation outlay for the provision of the signal S2 is kept low, by additionally using the actuating parameters from the beam formers 26 as are in any case necessary for the multichannel processing of the local microphone signals M1, M2, for setting the beam formers of the beam forming device 34.

By combining and mapping the actuating parameters of the beam formers 26 to the actuating parameters of the beam formers in the beam forming device 34 it is no longer necessary to also provide adaptive beam formers in the beam forming device 34, so that no corresponding calculation outlay is needed in the beam forming device 34. The beam forming device 34 is virtually remotely controlled by the beam formers 26.

Overall it can thus be determined that an additional signal delay when providing a signal for a binaural supply can be enabled by additional low-delay time domain directional microphone processing by the beam forming device 34. Additional calculation outlay is avoided in that the likewise available frequency domain directional microphone processing, which adapts independently, is also used to control the time domain directional microphone processing, by the actuating parameters being transmitted into the time domain by the mapping device 36.

The invention claimed is:

1. A hearing apparatus for a binaural supply, comprising:
- a first earhook to be worn on an ear, said first earhook containing:
  - an earpiece;
  - a plurality of microphones;
  - a first signal processing device having channels, said first earhook generating a local earpiece signal for said earpiece from microphone signals of said microphones using multichannel signal processing of each of the microphone signals;
  - a beam forming device having channels and generating a directional output signal from the microphone signals using signal processing which has fewer of said channels than that of said first signal processing device, said beam forming device being set up to split each of the microphone signals using filtering with a low-pass filter and a high-pass filter onto said channels of said beam forming device; and
  - a transmission device set up to transmit the directional output signal as an electrical or electromagnetic signal from said first earhook.

2. The hearing apparatus according to claim 1, wherein said beam forming device is set up to process each of the microphone signals in a time domain without sub-sampling and to retain a sampling rate which the microphone signals have at an input of said beam forming device, even after the microphone signals have been respectively split onto said channels of said beam forming device.

3. The hearing apparatus according to claim 1, wherein said beam forming device has a differential beam former and is set up to generate, in each of said channels from signal components of each the microphone signals contained therein, a corresponding component of the directional output signal by means of said differential beam former.

4. The hearing apparatus according to claim 1, wherein said beam forming device has an adaptive beam former in at least one of said channels.

5. A hearing apparatus for a binaural supply, comprising:
- a first earhook to be worn on an ear, said first earhook containing:
  - an earpiece;
  - a plurality of microphones;
  - a first signal processing device having channels, said first earhook generating a local earpiece signal for said earpiece from microphone signals of said microphones using multichannel signal processing of each of the microphone signals;

a beam forming device having channels and generating a directional output signal from the microphone signals using signal processing which has fewer of said channels than that of said first signal processing device, said beam forming device having a controlled beam former in at least one of said channels, in said controlled beam former a directional characteristic can be set for a channel using an actuating parameter; and a transmission device set up to transmit the directional output signal as an electrical or electromagnetic signal from said first earhook;

said first signal processing device being set up to set the actuating parameter.

6. The hearing apparatus according to claim 5, wherein said signal processing device has an adaptive beam former in at least one of said channels and sets the actuating parameter of said at least one controllable beam former of said beam forming device to a value which is calculated from the actuating parameter of said adaptive beam former.

7. The hearing apparatus according to claim 1, wherein said first earhook has a reception device for electrical or electromagnetic signal reception of an input signal, and said first signal processing device forms, on a basis of the microphone signals and the input signal, the local earpiece signal as a directional signal using binaural beam forming.

8. The hearing apparatus according to claim 1, wherein said first signal processing unit has more than 16 of said channels and said beam forming device has at most 16 of said channels.

9. The hearing apparatus according to claim 1, further comprising a second earhook to be worn on the other ear, said second earhook containing:

a plurality of further microphones;

a further beam forming device;

a further transmission device; and wherein said first and second earhooks transmit their respective directional output signals via said transmission device and said further transmission device to said respective other earhook and on a basis of the microphone signals of their own said microphones and of the respective signal received from the other earhook to generate the directional local earpiece signal using binaural beam forming.

10. The hearing apparatus according to claim 1, wherein said first signal processing unit has at least 48 of said channels and said beam forming device has 4 of said channels.

11. The hearing apparatus according to claim 1, further comprising at least one bandpass filter; and wherein said beam forming device is set up to split each of the microphone signals using time domain filtering, with said low-pass filter, said high-pass filter and said at least one bandpass filter, onto said channels of said beam forming device.

* * * * *